US006997028B2

(12) United States Patent
Schmode

(10) Patent No.: US 6,997,028 B2
(45) Date of Patent: Feb. 14, 2006

(54) CRIMPING TOOL

(75) Inventor: Hartmut Schmode, Blomberg (DE)

(73) Assignee: Weidmuller Interface GmbH & Co. KG, Detmold (DE)

( * ) Notice: Subject to any disclaimer, the term of this patent is extended or adjusted under 35 U.S.C. 154(b) by 25 days.

(21) Appl. No.: 10/700,540

(22) Filed: Nov. 5, 2003

(65) Prior Publication Data

US 2004/0093999 A1 May 20, 2004

(30) Foreign Application Priority Data

Nov. 16, 2002 (DE) ..... 202 17 733 U

(51) Int. Cl.
*H01R 43/042* (2006.01)

(52) U.S. Cl. ..... 72/409.16; 72/473; 29/751

(58) Field of Classification Search ..... 72/409.16, 72/409.01, 409.14, 413, 473, 477; 29/751
See application file for complete search history.

(56) References Cited

U.S. PATENT DOCUMENTS

| | | | | | |
|---|---|---|---|---|---|
| 484,891 | A | * | 10/1892 | Fairfield | 30/364 |
| 2,729,995 | A | * | 1/1956 | Friedman et al. | 72/404 |
| 2,762,414 | A | * | 9/1956 | Demler | 72/413 |
| 2,952,174 | A | * | 9/1960 | Broske | 72/409.01 |
| 3,103,245 | A | * | 9/1963 | Iskyan | 72/317 |
| 3,345,856 | A | * | 10/1967 | Werner et al. | 72/409.01 |
| 3,903,725 | A | * | 9/1975 | Rommel | 72/409.09 |
| 4,926,685 | A | * | 5/1990 | Shannon, Sr. | 72/409.11 |
| 5,211,050 | A | * | 5/1993 | Gouveia et al. | 72/409.16 |
| 5,500,998 | A | | 3/1996 | Schmode et al. | |
| 5,802,908 | A | * | 9/1998 | Frenken | 72/409.16 |
| 6,109,088 | A | * | 8/2000 | Schrader et al. | 72/409.16 |

FOREIGN PATENT DOCUMENTS

| | | |
|---|---|---|
| DE | 22 24 525 A | 5/1971 |
| DE | 93 09 984 UA | 7/1993 |
| DE | 100 60 165 A1 | 12/2000 |
| EP | 0 562 229 A2 | 1/1993 |
| EP | 0 562 229 B1 | 1/1993 |

* cited by examiner

*Primary Examiner*—Daniel C. Crane
(74) *Attorney, Agent, or Firm*—Lawrence E. Laubscher, Sr.; Lawrence E. Laubscher, Jr.

(57) ABSTRACT

A crimping tool includes a crimping drum that is rotatably supported within a housing for displacement between a plurality of crimping positions, thereby to position a selected one of a plurality of crimping dies opposite a window through which the bare end of an insulated conductor is introduced, characterized by the provision of a first drum locking arrangement that connects the drum to the housing via a die selecting wheel that is non-rotatably connected with the drum. A second retaining arrangement is operable to lock the other end of the crimping drum to the housing.

16 Claims, 6 Drawing Sheets

CRIMPING TOOL

BACKGROUND OF THE INVENTION

1. Field of the Invention

This invention relates to a hand-operated crimping tool operable to fasten various sizes and types of electrical connectors or terminals to the stripped bare ends of insulated conductors, characterized by the provision of means for releasably fastening a selectively rotatable crimping drum to its housing during a crimping operation.

2. Description of the Related Art

It is well known in the patented prior art—as evidenced by the European patent No. EP 0562229 B1—to provide a selectively operable crimping tool including arresting means for maintaining a crimping drum in a given crimping position during the fastening of an electrical connected to the stripped bare end of an insulated conductor. In this reference, an arresting nose engages the crimping drum or parts connected to it. This arresting nose can be pushed out of the locking position against a biasing force for the purpose of unlocking the crimping drum, for which purpose there is provided on the front of the housing of the crimping tool an operable shifting part that is connected with the arresting nose.

The rotation of the drum after unlocking into a new user position in which one uses another die is accomplished by means of an access from the outside. For this purpose, a flap is provided in the housing that can be opened and that then facilitates free access to the crimping drum. The crimping drum can be turned accordingly by manually acting on the crimping drum while simultaneously releasing the arresting nose out of the locking position.

This known design, however, entails considerable disadvantages, both as regards production and handling. For practical functional implementation, one requires a plurality of individual parts that result in relatively high production costs. Naturally, the vulnerability of the apparatus to trouble is also increased by the large number of parts and that reduces the service time of such crimping tools.

The handling of the crimping tool also leaves much to be desired because it is especially the unlocking and turning of the crimping drum that turn out to be somewhat laborious.

Moreover, one cannot rule out the possibility that the crimping drum might be placed in an erroneous position because the arresting nose cannot at all remain in an unengaged intermediate position. In other words, the arresting nose is not sufficiently suitable for ensuring the exact positioning of the crimping drum. This can result in damage to the crimping drum when the crimping swage in this intermediate position is pressed against the crimping drum.

The object of the invention at hand, therefore, is to provide an improved crimping tool that it will have a simpler structure and that it can be made more cheaply, that its service life will be improved and that it will be easier to handle.

BRIEF SUMMARY OF THE INVENTION

Accordingly, a primary object of the present invention is to provide a crimping tool having a crimping drum that is rotatable within a housing between a plurality of crimping positions for selectively supporting different sizes or types of electrical connectors during the fastening thereof to a bare wire end, in combination with a die selecting wheel for manually positioning the crimping drum in a given crimping position, and first locking means for locking the die selecting wheel to the housing during the crimping operation.

According to a more specific object of the invention, second locking means are provided for locking the crimping drum directly to the housing, during the crimping operation.

These proposed solutions facilitate the operation of the crimping tool with considerably less individual parts, especially in the area of the crimping drum when compared to the known crimping tools.

This results not only in a cheaper production of the functional components, but also in a simpler and thus cheaper assembly of the components.

Due to the small number of individual parts, one necessarily reduces the wear and tear which, in turn, increases the service life and ultimately reduces the processing costs of a cable that is to be worked on with the crimping tool.

According to one important advantage of the invention, the crimping drum, including a molded-on stop plate, will consist of metal. The possibility of false-positioning is less here when compared to the state of the art; one can thus prevent damage due to the movable crimping member, which again will improve the service life of the apparatus.

In the known prior art crimping tool, the stop plate consists of metal and the crimping drum is made of a synthetic plastic material, which must be suitably combined with each other. According to the present invention, however, the crimping drum is preferably made in one piece by means of the MIM (metal injection molding) process.

To operate the crimping drum in terms of a rotation and unlocking, the adjusting wheel is so firmly and non-rotatably connected with the crimping drum that the latter, due to pressure on the adjusting wheel in the axial direction, can be shifted into an unlocked position and can also be turned in that position.

The pre-determined catch positions in which the chosen die can be made to coincide with a conductor insertion opening of the housing are predetermined by mutually corresponding interlocking parts of the adjusting wheel, on the one hand, and the housing, on the other hand.

Such interlocking parts, for example, can be made up of catch cams on the adjusting wheel that in the engaged position rest against two neighboring catch brackets on the housing. To turn the adjusting wheel and thus the crimping drum, the wheel can be axially displaced out of the action range of the catch brackets and, for example, can be rotated within a relieved under cut of the catch brackets.

According to the catch positions, small labels can be provided on the adjusting wheel, displaying indicia in the form of size designations so that one can tell which die just happens to be in the working position for which line. The adjusting wheel preferably is made as a plastic injection molding part; the small labels in a practical manner must be provided at the same time, including the corresponding size designation.

A crimping tool according to the present invention compared to those of the prior art offers considerably easier handling because the crimping drum can be switched into a certain position practically with just one turn.

There is provided a catch knob that can be moved axially with respect to the crimping drum and that is spring-biased and that is located outside on the housing and that engages when the crimping drum is in the arresting position in a recess there in an interlocking manner.

According to the desired arresting positions, there are several recesses in the crimping drum, preferably each time in the insertion area of the dies.

The catch knob as well as the connected spring elements can be made as a unitary synthetic plastic injection molding part, and the spring force of the spring elements results from the elasticity force of the material.

BRIEF DESCRIPTION OF THE DRAWINGS

Other objects and advantages of the invention will become apparent from a study of the following specification when viewed in the light of the accompanying drawings, in which.

DETAILED DESCRIPTION OF THE INVENTION

Figure 1:
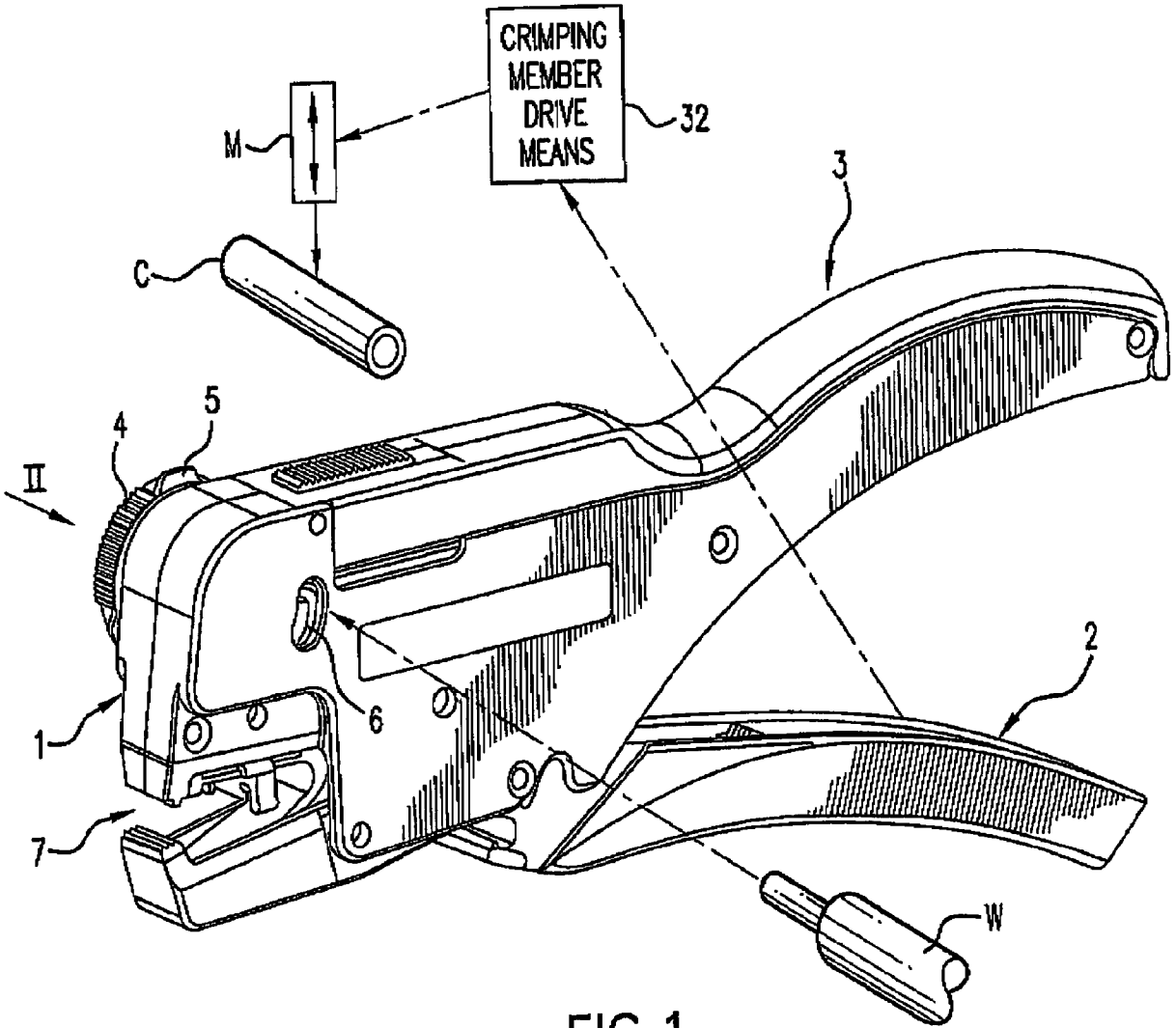
FIG. 1 is a front perspective view of the right hand side of the crimping tool of the present invention.
Figure 2:
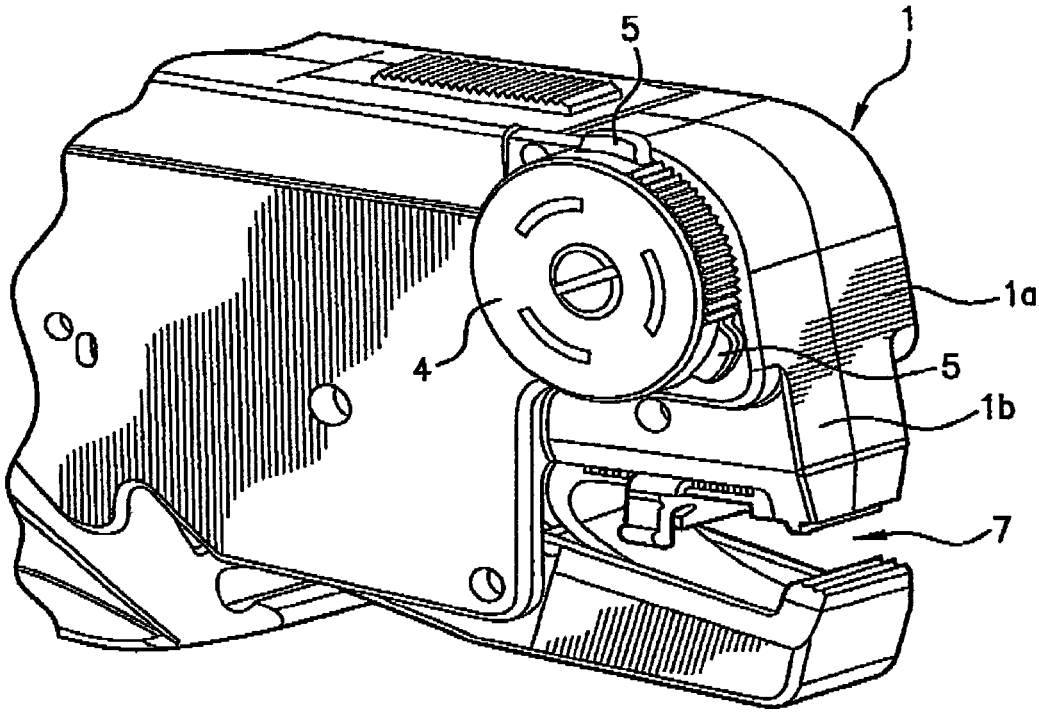
FIG. 2 is a detailed perspective view of the front left side of the crimping tool of FIG. 1.
Figures 3, 4:
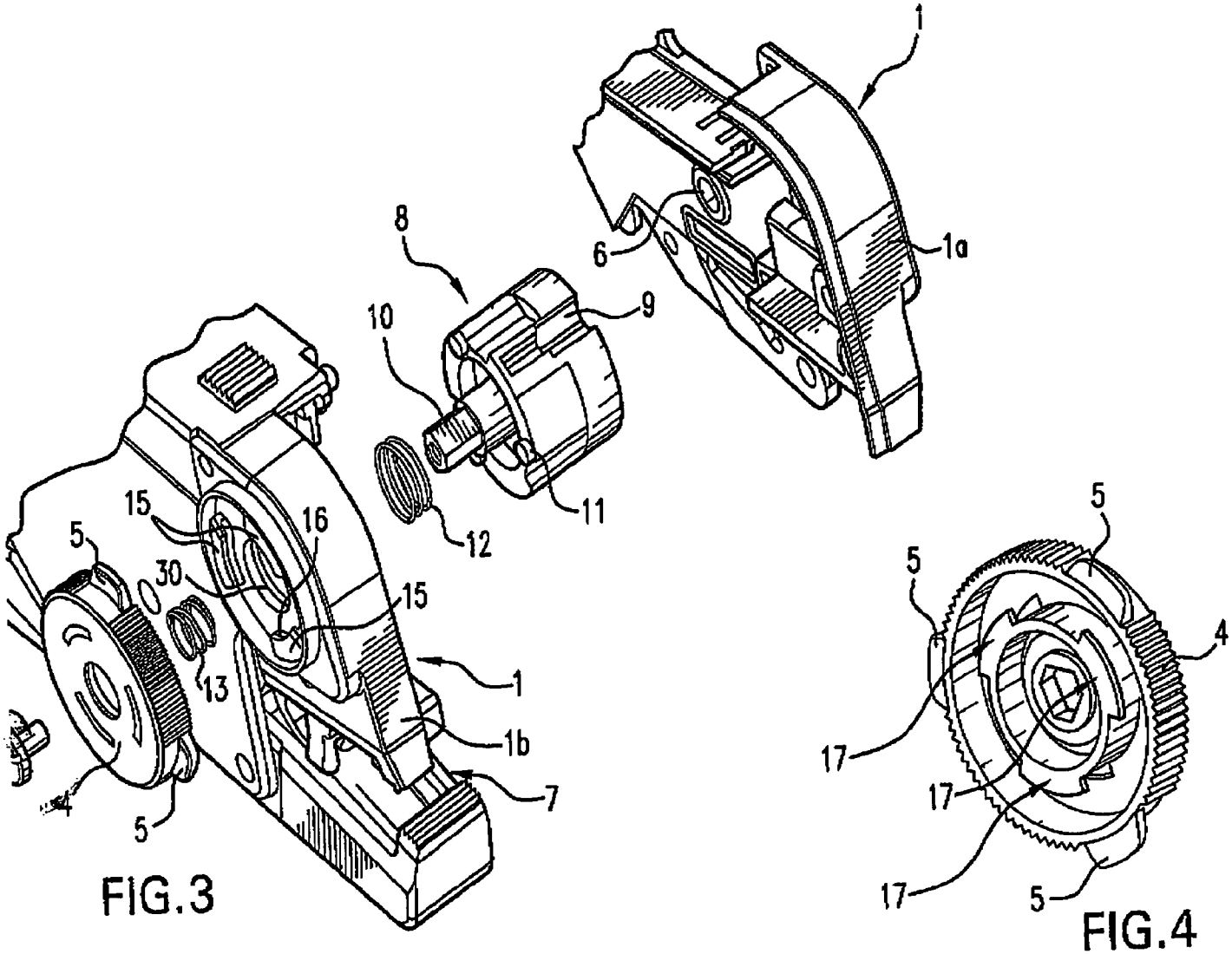
FIG. 3 is an exploded view of the crimping tool of FIG. 2.
FIG. 4 is a perspective view of the opposite side of the die selecting wheel of FIG. 3.

Referring first more particularly to FIGS. 1–3, the crimping tool of the present invention includes a housing 1 having integral therewith a fixed handle portion 3, and to which is pivotally connected a movable handle member 2. The housing contains a central chamber defined between a first housing side wall 1*a* containing a window 6 through which the bare end of the insulated wire W is inserted. Rotatably mounted within the chamber is a cylindrical crimping drum 8 having an axial bearing shaft portion 10 that extends through an opening 30 contained in the second housing side wall 1*b*. The crimping drum bearing shaft 10 is noncircular, and slideably and nonrotatably mounted on the free end thereof is a die selecting wheel 4 that is retained on the shaft 10 by the screw 14 that is threadably connected with the threaded bore contained in the shaft 10. Compression spring 13 concentrically mounted on the bearing shaft 10 normally biases the die selection wheel 4 away from the housing wall 1*b*, and a second compression spring 12 normally biases the crimping drum 8 in the opposite direction away from the housing side wall 1*b*. The movable and stationary handles 2 and 3 operate the jaws of conventional insulation stripping means 7.

The crimping drum 8—which is preferably molded from steel or other suitable metal by a metal injection molding method—contains on its outer periphery a plurality of crimping die members 9 that are selectively positioned opposite the opening 6 contained in the first housing side wall 1*a* through which the bare end of the insulated wire W is introduced. The various dies on the outer periphery of the crimping drum have different sizes and/or configurations for receiving different sizes and types of the connectors or terminals C that are to be crimped on the bare end of the insulated wire W, as is known in the art. To this end a movable crimping member M is provided in the housing chamber for displacement by drive means 32 operable the moveable handle member 2, thereby to cooperate with the corresponding die 9 to crimp the electrical connector or terminal C upon the bare end of the insulated wire or conductor W. The connectors C are supplied by magazine means (not shown) contained within the stationary handle portion 3.

The die selecting wheel is provided with a plurality of spaced indicia labels 5 to visibly indicate that one of the die members on the periphery of the crimping die is opposite the conductor introducing opening 6 at any given time.

In accordance with the present invention, first retaining means are provided for maintaining the crimping drum 8 in place during the crimping operation. To this end, the adjusting wheel 4 is provided with a plurality of circumferentially spaced catch cams 17 (FIG. 4) that are adapted to cooperate with corresponding catch brackets 15 provided on the second wall 1*b* of the housing 1, as best shown in FIG. 3. Thus, when the catch cams 17 on the die selecting wheel 4 abut the corresponding catch brackets 15 on the housing section 1*b*, the crimping drum 8 is locked in the selected position, as indicated by the indicia labels 5. In order to release the crimping drum for rotation to another crimping position at which a further die 9 is arranged opposite the conductor introducing opening 6, the stationary catch brackets 15 are provided with under cut grooves 16 (FIG. 3) that are adapted to receive the catch cam 17 on the adjusting wheel, thereby to permit angular rotation of the die selecting wheel 4, and consequently, the crimping drum 8. Similarly, the crimping drum 8 may be shifted toward the housing wall 1*b* by the bare end of an insulated conductor W, thereby to compress the compression spring 12 and to displace the die selecting wheel 4 outwardly to a position in which the catch cams 17 no longer engage the catch brackets 15, whereupon the crimping drum is free for rotation to a further crimping position.

Figure 6:
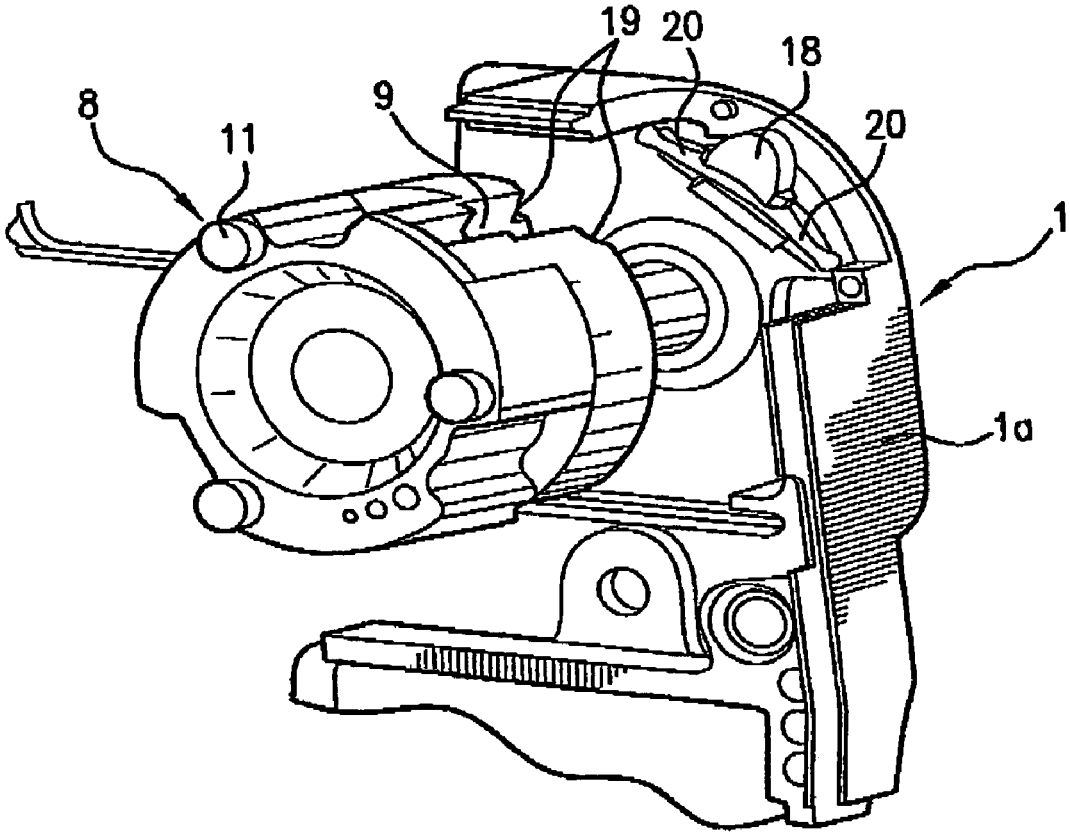
Figure 7:
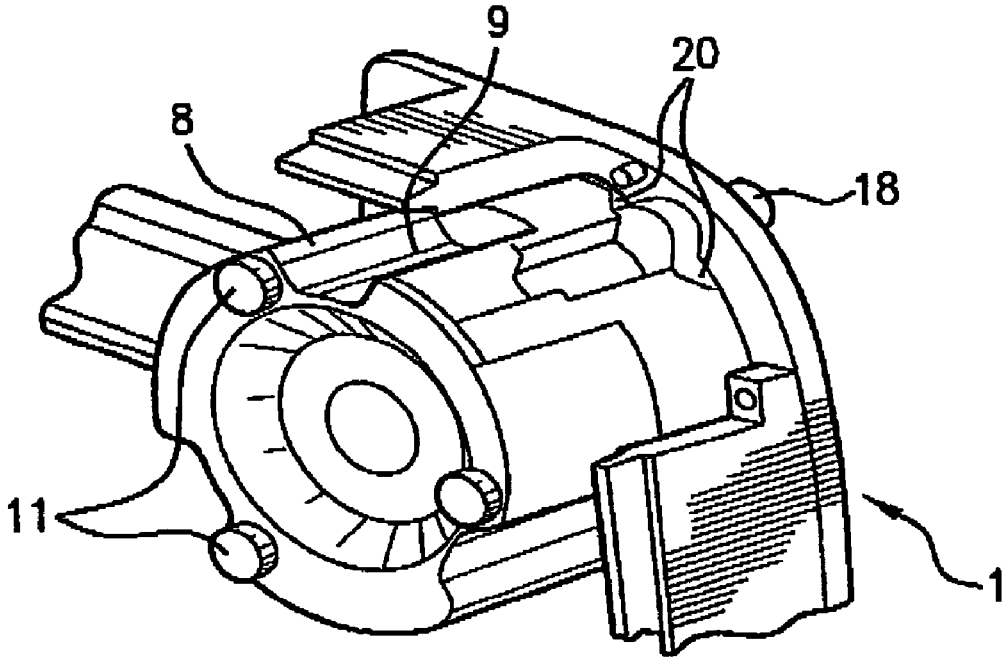

In accordance with a further feature of the invention, second retaining means may be provided for connecting the other end of the crimping drum with the first housing wall 1*a*, thereby to prevent rotational displacement of the crimping drum from a given selected position. To this end, there is slideably mounted in a opening contained in the first housing wall 1*a* a retaining knob 18 that is molded from a suitable resilient synthetic plastic material includes a pair of resilient radially outwardly extending spring fingers 20 that are adapted to extend within a corresponding recess 19 contained in the adjacent end of the crimping drum 8, as best shown in FIG. 6. Thus, when the spring fingers 20 extend within the corresponding recesses 19 contained in the crimping drum, the crimping drum is restrained against rotation relative to the housing 1.

To release the crimping drum at its right hand end, the retaining knob 18 may be axially displaced toward a released position in which the spring fingers 20 are removed from the recesses 19. Alternatively, the crimping drum may be displaced away from the locked position adjacent the housing wall 1*a* by the bare end of the insulated conductor, whereupon the crimping drum is unlocked and free for rotation by the die selecting wheel 4 to another crimping position, thereby to position another die 9 of different size or configuration opposite the opening 6. The crimping drum can also be rotated to a locked-out position in which the locking lugs are in front of the locking lugs 15 on the housing, thereby to retain the crimping drum against the biasing force of spring 12.

In operation, assume that the crimping drum 8 is in a given position with a first die 9 arranged adjacent the conductor insertion opening 6. Assume also that the retaining-knob 18 is in the locking position with the resilient fingers 20 thereof extending within the corresponding recesses 19 contained in the adjacent end of the crimping die 8. Assume further that locking lugs 17 on the die selection wheel 4 are in engagement with the locking lugs 15 on the housing, thereby to lock the other end of the crimping drum to the housing.

To rotate the crimping drum 8 to cause another selected die 9 thereon to be arranged adjacent the opening 6, the retaining knob 18 is withdrawn to remove the resilient fingers 20 from the drum recesses 19, whereupon the die selecting wheel 4 is axially displaced in the direction of the crimping drum 9 against the biasing force of the compression spring 13. The locking lugs 17 on the wheel 4 are opposite the undercut grooves 16 contained in the housing locking lugs 15, thereby permitting rotation of the drum to a desired position by wheel 4 owing to the noncircular, nonrotational connection between wheel 4 and axial shaft 10 that is integral with crimping drum 8. The retaining knob 18 is then axially shifted to cause the spring fingers 20 to be inserted into the corresponding recesses 19 contained in the adjacent end of the crimping drum, whereupon the wheel 4 is released for displacement away from the drum 9, thereby to effect locking engagement between the locking lugs 17 on the wheel and the corresponding locking lugs on the housing. Upon displacement of the movable die member M by the movable handle 2 via the drive means 32, one can crimp an individual connector or terminal C onto the bare end of an insulated conductor W that is inserted into the housing chamber via the opening 6, which connector C is supplied from the magazine supported by the new die 9 that is now positioned opposite the opening 6 at that time. The supply of the connectors C from the magazine within the housing handle 3 to the die means 9 for crimping by the movable member M is known in the art and forms no part of the present invention.

In accordance with another feature of the invention, there are distributed over the circumference of the wheel 4 to indicate the die positions a plurality of small labels 5 extending radially along adjusting wheel 4, which small labels display a cable designation, for example, in the form of a conductor cross-section figure, where label 5 that displays the designation for the particular die in use is freely visible so that the user of the crimping tool can see very easily in which position the crimping drum 8 or die 9 happen to be for the moment in the working position.

Figure 5:
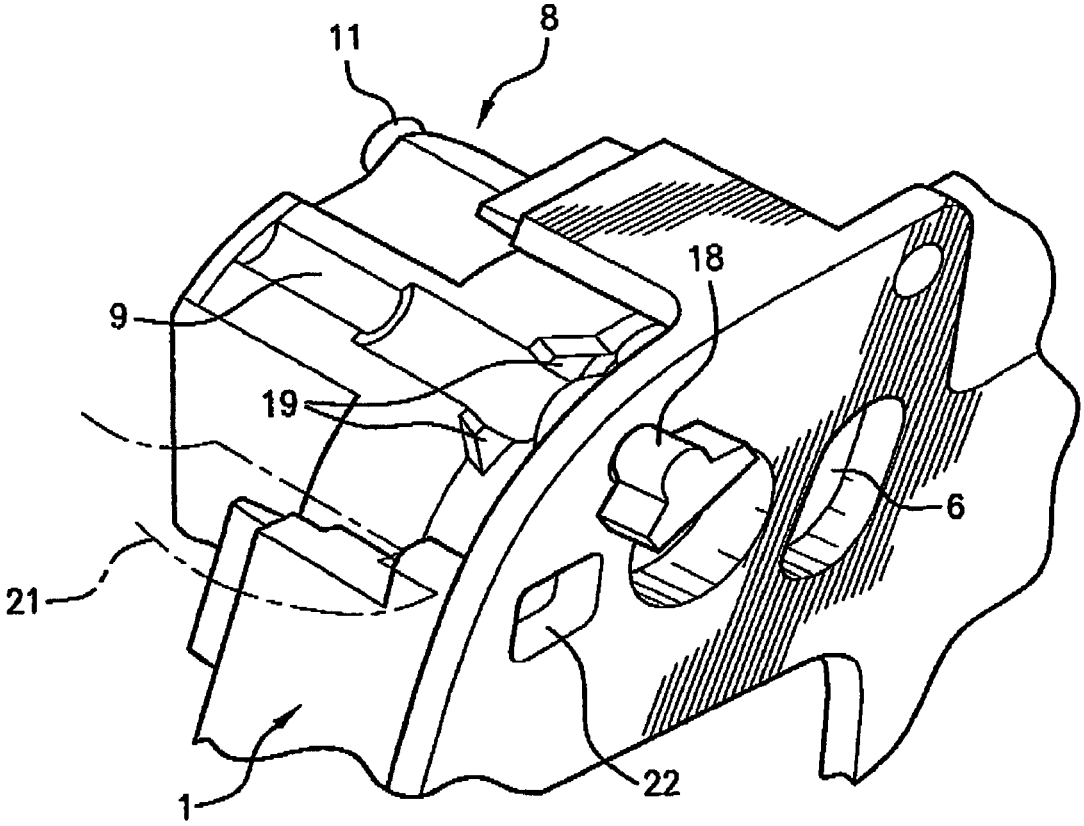
FIGS. 5–7 are detailed perspective views illustrating the means for locking the crimping drum to the housing.

To move another die into a user position, the arrest is released by pulling retaining knob 18, and the crimping drum 8 can be rotated freely for which purpose a flap 21 (FIG. 5) is provided in housing 1, and this flap can be opened and thus provides clear access to the crimping drum 8. By letting go of the retaining knob 18, the latter automatically snaps into the associated recess 19 of the die 9, which is then located in that area.

In the known manner, an observation window 22 is provided in the housing in which window one can recognize a display attached on the crimping drum 8 through which the particular die 9 in the user position can be recognized.

While in accordance with the provisions of the Patent Statutes the preferred forms and embodiments of the invention have been illustrated and described, it will be apparent to those skilled in the art that various changes may be made without deviating from the inventive concepts set forth above.

What is claimed is:

1. A crimping tool for fastening a female connector to the bare end of an insulated conductor, comprising:

(a) a housing (1) containing a chamber defined between a pair of side walls, a first one of said side walls containing a first opening through which the conductor bare end is introduced into said chamber;

(b) crimping means ranged in said chamber for fastening a female connector to the conductor bare end, including:

(1) a cylindrical crimping drum (8) ranged in said chamber for rotation about a given axis parallel with said first wall opening, said crimping drum having at one end an axial bearing shaft (10) that extends through a second wall opening (30) contained in the opposite second side wall of said housing, the peripheral surface of said drum being adjacent said wall opening and supporting thereon a plurality of circumferentially spaced dies of different types or sizes, said crimping drum being rotatable about said bearing shaft between a plurality of crimping positions in which said dies are arranged opposite said wall opening, respectively;

(2) a movable crimping member (M) arranged in said chamber adjacent said first wall opening for cooperation with a given die in the crimping position adjacent said first wall opening, thereby to crimp and fasten a connector supported by said die onto said bare conductor; and (3) handle means (2, 3) supported by said housing for operating said crimping member between crimping and withdrawn positions relative to said given die;

(c) a die selection wheel (4) non-rotatably connected with said bearing shaft on the opposite side of said second wall from said crimping drum; and (d) first retaining means (15,17) releasably connecting said die selection wheel against angular rotation relative to said housing, thereby to maintain said crimping drum in said given crimping position, said first retaining means including a plurality of radially-outwardly-extending circumferentially-spaced retaining lugs (17) carried by said die selection wheel for engagement with corresponding retaining lugs (15) on said housing.

2. A crimping tool as defined in claim 1, and further including:

(e) second retaining means (18,19) for releasably connecting said crimping drum with said first housing side wall.

3. A crimping tool as defined in claim 2, wherein said crimping drum is formed from metal.

4. A crimping tool as defined in claim 3, wherein said crimping drum is formed from steel by the use of a metal injection molding process.

5. A crimping tool as defined in claim 1, wherein said housing retaining lugs include undercut portions (16) that are operable, following axial displacement of said selection wheel toward said released position, to permit the passage of the corresponding retaining lugs on said die selection wheel during angular adjustment of said die selection wheel relative to said housing.

6. A crimping tool as defined in claim 5, wherein said crimping drum is ranged for axial displacement in the direction of said second housing wall toward a disengaged position in which the retaining lugs (17) on said die selection wheel are disengaged from the corresponding lugs (15) on said housing, thereby to permit angular adjustment of said crimping drum between said crimping positions.

7. A crimping tool as defined in claim 1, and further including indicia means (5) arranged on the periphery of said die selecting wheel for indicating that one of said dies that is arranged opposite said first opening at any given time.

8. A crimping tool as defined in claim 7, wherein said indicia means is arranged at a visible location relative to said housing.

9. A crimping tool as defined in claim 1, wherein the number of retaining lugs on said die selecting wheel corresponds with the number of dies carried by said crimping drum.

10. A crimping tool as defined in claim 2, wherein said second retaining means comprises an axially displaceable locking knob (18) connected with said first wall, said locking knob including at one end adjacent said crimping drum a plurality of radially outwardly directed spring clip elements that extend within corresponding locking recesses (19) contained in the adjacent end of said crimping drum.

11. A crimping tool as defined in claim 10, wherein a plurality of said locking recesses are arranged adjacent each of said dies that are carried by said crimping drum.

12. A crimping tool as defined in claim 10, wherein said locking knob and said spring clip elements are formed integrally from a resilient synthetic plastic material.

13. A crimping tool as defined in claim 2, wherein said crimping drum is axially displaceable between a locked position adjacent said first housing wall and an unlocked position spaced from said first housing wall, said second retaining means being operable only when said crimping drum is in said locked position.

14. A crimping tool as defined in claim 13, and further including second spring means (12) biasing said crimping drum axially in the direction of said first wall toward said locked position.

15. A crimping tool for fastening a female connector to the bare end of an insulated conductor, comprising:

(a) a housing (1) containing a chamber defined between a pair of side walls, a first one of said side walls containing a first opening through which the conductor bare end is introduced into said chamber;

(b) crimping means arranged in said chamber for fastening a female connector to the conductor bare end, including;

(1) cylindrical crimping drum (8) arranged in said chamber for rotation about a given axis parallel with said first wall opening, said crimping drum having at one end an axial bearing shaft (10) that extends through a second wall opening (30) contained in the opposite second side wall at said housing, the peripheral surface of said drum being adjacent said wall opening and supporting thereon a plurality of circumferentially spaced dies of different types or sizes, said crimping drum being rotatable about said bearing shaft between a plurality of crimping positions in which said dies are arranged opposite said wall opening, respectively;

(2) a movable crimping member (M) arranged in said chamber adjacent said first wall opening for cooperation with a given die in the crimping position adjacent said first wall opening, thereby to crimp and fasten a connector supported by said die onto said bare conductor; and (3) handle means (2, 3) supported by said housing for operating said crimping member between crimping and withdrawn positions relative to said given die;

(c) a die selection wheel (4) continuously non-rotatably connected with said bearing shaft on the apposite side of said second wall from said crimping drum; and (d) first retaining means (15,17) releasably connecting said die selection wheel against angular displacement relative to said housing, thereby to maintain said crimping drum in said given crimping position;

(e) said die selection wheel (4) being axially displaceable on, and continuously non-rotatably connected with, said crimping drum shaft (10) between locked and released positions relative to said housing.

16. A crimping tool as defined in claim 15, and further including first spring means (13) biasing said die selection wheel toward said locked position.

* * * * *